US012716426B1

(12) United States Patent
Rose

(10) Patent No.: US 12,716,426 B1
(45) Date of Patent: Aug. 25, 2026

(54) DOWNHOLE CENTRIFUGAL PUMPS INCLUDING AXIAL SUPPORT FEATURES AND RELATED COMPONENTS AND METHODS

(71) Applicant: CHAMPIONX LLC, Sugar Land, TX (US)

(72) Inventor: Emily Rose, Tulsa, OK (US)

(73) Assignee: CHAMPIONX LLC, Sugar Land, TX (US)

( * ) Notice: Subject to any disclaimer, the term of this patent is extended or adjusted under 35 U.S.C. 154(b) by 0 days.

(21) Appl. No.: 19/250,018

(22) Filed: Jun. 25, 2025

(51) Int. Cl.
*F04D 29/44* (2006.01)
*E21B 43/12* (2006.01)
(Continued)

(52) U.S. Cl.
CPC ..... *F04D 29/445* (2013.01); *F04D 1/00* (2013.01); *F04D 29/046* (2013.01); *F04D 29/628* (2013.01); *E21B 43/121* (2013.01)

(58) Field of Classification Search
CPC .. F04D 13/10; F04D 29/0413; F04D 29/0473; F04D 1/06; F04D 29/047; F04D 29/628; F04D 29/046; F04D 13/08; F04D 29/041; F04D 1/063; F04D 13/086; F04D 29/448; F04D 29/669; F04D 29/043; F04D 29/061; F04D 29/086; F04D 29/426; F04D 1/04; F04D 1/10; F04D 29/042; F04D 29/044; F04D 29/0462; F04D 29/106; F04D 29/12; F04D 29/167; F04D 29/18; F04D 29/20; F04D 29/2266; F04D 29/445; F04D 29/548; F04D 1/00; F04D 1/08; F04D 17/12; F04D 25/0686; F04D 29/026; F04D 29/056; F04D 29/605; F16C 2360/44; F16C 35/02; F16C 17/10; F16C 2226/14; F16C 2226/12; F16C 27/02; F05D 2260/36;
(Continued)

(56) References Cited

U.S. PATENT DOCUMENTS 7,575,413 B2 * 8/2009 Semple ..... F04D 13/10 384/275
8,684,679 B2 * 4/2014 Tetzlaff ..... F04D 29/046 415/170.1
(Continued)

OTHER PUBLICATIONS

How to Select the Proper Pin for Your Application, by Christie Jones, Copyright 2020 (Year: 2020).

*Primary Examiner* — Eric J Zamora Alvarez
(74) *Attorney, Agent, or Firm* — BKRIP LLC

(57) ABSTRACT

A centrifugal pump may include a housing, a plurality of diffusers fixedly coupled to the housing, and a plurality of impellers alternatingly interspersed between the plurality of diffusers. The centrifugal pump may additionally include a bearing support fixedly coupled to the housing, the bearing support comprising a central opening having a shoulder in a lower portion of the central opening. A bushing may be positioned within and coupled to the central opening of the bearing support. A flanged bearing may have an annular portion positioned at least partially within the bushing and a flange portion extending radially at least partially over an upper surface of the bushing, the upper surface of the bushing sized relative to the flange portion to prevent downward axial movement of the flange portion beyond the upper surface of the bushing.

23 Claims, 6 Drawing Sheets

(51) Int. Cl.
*F04D 1/00* (2006.01)
*F04D 29/046* (2006.01)
*F04D 29/62* (2006.01)

(58) Field of Classification Search
CPC ..... F05D 2230/642; F05D 2240/55; F05D 2260/37; F04B 47/06; F05B 2240/52; E21B 43/121
See application file for complete search history.

(56) References Cited

U.S. PATENT DOCUMENTS

| | | | | |
|---|---|---|---|---|
| 9,353,752 | B2 * | 5/2016 | Tetzlaff | F04D 13/10 |
| 9,500,202 | B1 * | 11/2016 | Davis | F04D 29/0413 |
| 9,677,560 | B1 | 6/2017 | Davis | |
| 10,145,380 | B1 | 12/2018 | Davis | |
| 10,280,929 | B2 * | 5/2019 | Gahlot | F04D 29/061 |
| 10,344,866 | B2 * | 7/2019 | Ye | F04D 29/106 |
| 2003/0215059 | A1 | 11/2003 | Higgins | |
| 2015/0023815 | A1 | 1/2015 | Tetzlaff | |
| 2015/0071799 | A1 | 3/2015 | Johnson | |
| 2017/0002823 | A1 | 1/2017 | Gahlot | |
| 2017/0058616 | A1 | 3/2017 | Lunk | |
| 2017/0159668 | A1 | 6/2017 | Nowitzki | |
| 2020/0116152 | A1 * | 4/2020 | Smith | F04D 1/06 |
| 2021/0048029 | A1 | 2/2021 | Ye | |
| 2021/0140436 | A1 | 5/2021 | Ye | |
| 2021/0404474 | A1 * | 12/2021 | Gottschalk | F04D 29/0413 |

* cited by examiner

DOWNHOLE CENTRIFUGAL PUMPS INCLUDING AXIAL SUPPORT FEATURES AND RELATED COMPONENTS AND METHODS

TECHNICAL FIELD

The present disclosure generally relates to pumps and, in particular, to axial support features for downhole centrifugal pumps for at least partially restricting axial movement of rotating components of the pump relative to stationary components of the pump during the operation of a downhole centrifugal pump system.

BACKGROUND

Submersible pumps are generally used to provide "artificial lift" or artificial methods that increase upward fluid flow from downhole sources, such as production wells. In most instances, submersible pumps include a motor portion that drives a shaft coupled to impellers which are in turn rotationally coupled to diffusers. The impellers and diffusers are alternatingly situated around the shaft in a manner that causes fluid to flow from one impeller into a diffuser, and from the diffuser into another impeller as the shaft rotates. This process of fluid transfer from impeller to diffuser, and from diffuser to an adjacent upper impeller, repeats until the fluid travels from the downhole source to an upper destination.

Impellers are designed to accelerate fluid flow upwardly as the fluid is input into the pump from a fluid inlet. Diffusers are built to direct fluid flow to an adjacent upper impeller or to a fluid outlet of the pump. Specifically, diffusers generally have vanes that direct the fluid flow to decrease velocity and build fluid pressure when transferring fluid to the adjacent upper impeller or to the fluid outlet. The vanes of a diffuser include a lower pressure surface that receives fluid from an adjacently lower impeller and a higher pressure surface that directs the fluid to the adjacently upper impeller. After being moved through the impellers and diffusers of the pump, the fluid exits the pump, for example, to an uphole component in a downhole string.

During the rotation the impellers and the artificial lifting of the fluid through the pump, the components of the pump may be subjected to internal and/or external forces (e.g., fluid pressure forces, rotational forces, gravitational forces, etc.) that may impact operation of the pump. For example, such forces may act to apply axial forces (e.g., forces acting in an axial direction) on components, such as rotating components, of the pump. Accordingly, such axial forces may reduce the efficiency of the pump, may cause damage to the pump, and/or may result in operational failure of the pump.

SUMMARY

Some embodiments of the instant disclosure may relate to centrifugal pumps including at least one axial support feature, such as one or more flanged bearings, to provide axial support to at least one impeller.

In some aspects, the techniques described herein relate to a downhole centrifugal pump including: a housing; a plurality of diffusers fixedly coupled to the housing; a plurality of impellers alternatingly interspersed between the plurality of diffusers; a bearing support located below the plurality of impellers and fixedly coupled to the housing, the bearing support including a central opening having a shoulder in a lower portion of the central opening; a bushing positioned within and fixedly coupled to the central opening of the bearing support, with a bottom surface of the bushing positioned adjacent to the shoulder, and the shoulder sized relative to the bushing to prevent downward axial movement of the bushing beyond the shoulder; a flanged bearing with an annular portion and a flange portion, the annular portion of the flanged bearing positioned at least partially within the bushing and at least a portion of the flange portion extending radially over an upper surface of the bushing, the upper surface of the bushing sized relative to the flange portion to prevent downward axial movement of the flange portion beyond the upper surface of the bushing; and a shaft passing through the plurality of diffusers, the plurality of impellers, the bearing support, the bushing, and the flanged bearing, the shaft rotationally coupled to the impellers and the flanged bearing and configured to impart rotation to the impellers and the flanged bearing relative to the housing.

In some aspects, the techniques described herein relate to a downhole centrifugal pump, wherein the flanged bearing is comprised of a material having a hardness equal to or greater than tungsten carbide.

In some aspects, the techniques described herein relate to a downhole centrifugal pump, further including an annular bearing located below the flanged bearing, the annular bearing rotationally coupled to the shaft and located at least partially within the bushing.

In some aspects, the techniques described herein relate to a downhole centrifugal pump, wherein each of the flanged bearing, the annular bearing, and the bushing has a hardness equal to or greater than tungsten carbide.

In some aspects, the techniques described herein relate to a downhole centrifugal pump, further including a retaining ring coupled to the shaft at a location below the flanged bearing.

In some aspects, the techniques described herein relate to a downhole centrifugal pump, further including at least one spacer coupled to the shaft at a location between the plurality of impellers and the flanged bearing, the at least one spacer extending axially between and in contact with a bottom impeller of the plurality of impellers and the flanged bearing.

In some aspects, the techniques described herein relate to a downhole centrifugal pump, the at least one spacer extending axially between and in contact with the bottom impeller of the plurality of impellers and the flanged bearing, wherein the at least one spacer is located and configured to transfer axial forces from the bottom impeller to the flanged bearing.

In some aspects, the techniques described herein relate to a downhole centrifugal pump, wherein the flange portion of the flanged bearing extends radial beyond an outer diameter of the bushing.

In some aspects, the techniques described herein relate to a centrifugal pump including: a bottom impeller; a bearing support located below the bottom impeller; a bushing fixedly coupled to the bearing support; a flanged bearing positioned at least partially within the bushing, the flanged bearing having a flange extending radially over at least a portion of an upper surface of the bushing; and a shaft passing through the bottom impeller, the bearing support, the bushing, and the flanged bearing, the shaft rotationally coupled to the bottom impeller and the flanged bearing and configured to impart rotation to the bottom impeller and the flanged bearing relative to the bearing support and the bushing.

In some aspects, the techniques described herein relate to a centrifugal pump, wherein the flange of the flanged bearing extends radial beyond an outer diameter of the bushing.

In some aspects, the techniques described herein relate to a centrifugal pump, wherein the flange of the flanged bearing includes a substantially planar lower surface positioned adjacent a substantially planar upper surface of the bushing.

In some aspects, the techniques described herein relate to a centrifugal pump, wherein the bearing support includes an opening including a lower portion with a diameter that is smaller than an outer diameter of the bushing to prevent the bushing from entering the lower portion, and a middle portion with a diameter sized to provide a press fit between the bushing and the middle portion.

In some aspects, the techniques described herein relate to a centrifugal pump, wherein the opening further includes an upper portion with a diameter larger than the outer diameter of the bushing.

In some aspects, the techniques described herein relate to a centrifugal pump, wherein the flange of the flanged bearing is located in the upper portion and extends radial beyond the outer diameter of the bushing.

In some aspects, the techniques described herein relate to a centrifugal pump, wherein the flanged bearing is comprised of tungsten carbide In some aspects, the techniques described herein relate to a centrifugal pump, further comprising at least one spacer coupled to the shaft and extending axially between and in contact with the bottom impeller and the flanged bearing.

In some aspects, the techniques described herein relate to a centrifugal pump, the at least one spacer extending axially between and in contact with the bottom impeller and flanged bearing, wherein the at least one spacer may transfer axial forces from the bottom impeller to the flanged bearing.

In some aspects, the techniques described herein relate to a centrifugal pump, wherein the bushing is comprised of tungsten carbide.

In some aspects, the techniques described herein relate to a centrifugal pump, further including: an upper impeller; a diffuser located between the bottom impeller and the upper impeller; an upper bushing fixedly coupled to the diffuser; and an upper flanged bearing positioned at least partially within the upper bushing, the upper flanged bearing having a flange extending radially over at least a portion of an upper surface of the upper bushing.

In some aspects, the techniques described herein relate to a method of assembling a centrifugal pump, the method including: coupling a bushing to a bearing support; coupling a bottom impeller to a shaft; coupling a flanged bearing to the shaft, below the bottom impeller; inserting a lower portion of the flanged bearing into the bushing and positioning a flange of the flanged bearing onto an upper surface of the bushing.

In some aspects, the techniques described herein relate to a method, wherein coupling the bushing to the bearing support includes press-fitting the bushing into an opening in the bearing support and positioning a lower surface of the bushing against a shoulder in the opening.

In some aspects, the techniques described herein relate to a method, further including coupling at least one spacer to the shaft and positioning the at least one spacer to extend from the bottom impeller to the flanged bearing.

In some aspects, the techniques described herein relate to a method, wherein positioning the flange of the flanged bearing onto the upper surface of the bushing further includes positioning the flange to extend beyond an outer diameter of the bushing.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

DETAILED DESCRIPTION

As used herein, relational terms, such as "first," "second," "top," "bottom," etc., are generally used for clarity and convenience in understanding the disclosure and accompanying drawings and do not connote or depend on any specific preference, orientation, or order, except where the context clearly indicates otherwise.

As used herein, the term "and/or" means and includes any and all combinations of one or more of the associated listed items.

As used herein, the terms "vertical," "lateral," "radial," "uphole," and "downhole" refer to the orientations as depicted in the figures.

Terms of degree (e.g., "about," "substantially," "generally," etc.) indicate structurally or functionally insignificant variations. In an example, when the term of degree is included with a term indicating quantity, the term of degree is interpreted to mean±10%, ±5%, or +2% of the term indicating quantity. In an example, when the term of degree is used to modify a shape, the term of degree indicates that the shape being modified by the term of degree has the appearance of the disclosed shape. For instance, the term of degree may be used to indicate that the shape may have rounded corners instead of sharp corners, curved edges instead of straight edges, one or more protrusions extending therefrom, is oblong, is the same as the disclosed shape, et cetera.

Embodiments of the instant disclosure are directed to exemplary fluid handling devices (e.g., pumps) that include one or more axial support features, such as flanged bearings. Such axial support features may act to at least partially maintain (e.g., substantially maintain, substantially prevent axial movement of) the position of one or more components of the fluid handling device, such as one or more impellers.

For example, a pump (e.g., a submersible pump, an electric submersible pump (ESP), a centrifugal pump, a multistage centrifugal pump, or any suitable pump, without limitation) may include or be coupled to a motor that drives a shaft coupled to impellers which are, in turn, rotationally coupled to diffusers. The impellers and diffusers are alternatingly situated around the shaft in a manner that causes fluid to flow from one impeller into a diffuser, and from the diffuser into another impeller as the shaft rotates. This process of fluid transfer from impeller to diffuser, and from diffuser to an adjacent upper impeller, repeats until the fluid travels from the downhole source to an upper destination.

Figure 1:
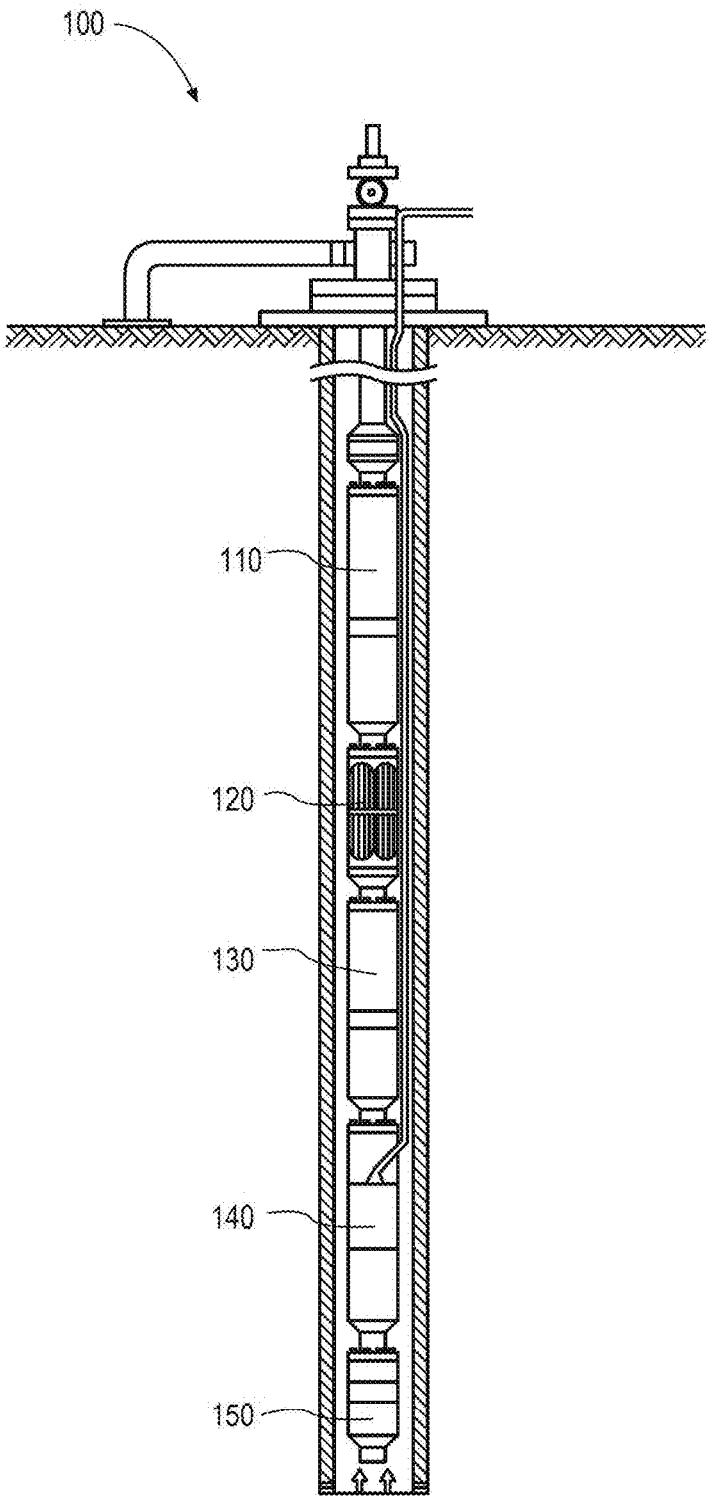
FIG. 1 is a simplified side or elevation view of a downhole centrifugal pump system according to an embodiment of the disclosure.

FIG. 1 is a simplified side or elevation view of a downhole centrifugal pump system 100 that may include one or more pumps 110 according to an embodiment of the present disclosure. Downhole centrifugal pump systems may include at least a downhole structure housing a pump coupled to a motor. In some implementations, the downhole structure may include a plurality of pumps coupled to a plurality of motors. Depending on the use scenario, the downhole structure can be submerged in one or more fluid sources (e.g., oil or gas reservoir, aquifer, etc.) as needed. The plurality of pumps in the downhole structure may upwardly pump the fluid from the fluid source to receiving containers (e.g., tanks, vessels, etc.) at a higher elevation relative to the fluid source.

As shown in FIG. 1, the downhole centrifugal pump system 100 may include one or more pumps 110, one or more gas handling devices 120, one or more protector devices 130, one or more motors 140, and one or more monitoring devices 150.

The pump 110 may include a series of impellers and diffusers that are alternatingly located relative to each other. As above, in some implementations, the pump 110 may be an electric submersible pump (ESP) configured to operate in relatively high-volume wells, horizontal wells, and/or highly deviated wells. For example, the pump 110 may facilitate fluid production from between about 150 barrels per day (BPD) and about 10,000 BPD and may range in size from about 2 inches to more than about 7 inches (about 5.08 to about 17.78 centimeters) in diameter (e.g., about 4 inches (about 10.16 centimeters)). This relatively wide specification range may allow the pump 110 to be adaptable to various drilling conditions. Additionally, the pump 110 may be abrasion-resistant and may enable the ability to handle solids in, for example, high sand production scenarios.

Referring again to FIG. 1, the gas handling device 120 may be configured to inhibit gas locking by reducing gas interference in the pump 110. In some implementations, the gas handling device 120 may incorporate rotary and/or vortex gas separators that may enhance pump efficiency by inhibiting free gas from entering the pump 110. Operations executed by the gas handling device 120 may maximize fluid production by lowering pump drawdown and facilitating well uptime.

The protector device 130 may be configured to facilitate the electrical and/or mechanical integrity of the motor 140. The motor 140 (e.g., an electric motor, a hydraulic motor, an internal combustion engine, another type of prime mover, etc.) may provide power to operate the pump 110, such as by rotating one or more shafts that may run through the length of pump 110 and that may be coupled to impellers disposed within the pump 110.

In some implementations, the protector device 130 may act as an oil reservoir that facilitates the expansion capacity of the motor 140. The protector device 130 may include a secure seal that may keep the motor 140 running smoothly. Additionally, the protector device 130 may further include one or more chambers adapted to inhibit wellbore fluid contamination of the motor 140 by creating a low-pressure boundary between the well fluid and clean oil used to lubricate the motor 140. Moreover, the protector device 130 may facilitate: torque transfer from the motor shaft to the gas handling device 120 and/or pump intake shaft; reinforcement of the pump shaft; and/or adaptation of the downhole centrifugal pump system 100 to specific implementation considerations.

The motor 140 may be configured to drive a shaft coupled to the pump 110 of the downhole centrifugal pump system 100. In some embodiments, the motor 140 may be an electric submersible motor configured for variable-speed operations, high temperature tolerance, and deep well pumping. The motor 140 may include circuitry that allows 3-phase operations, 2-pole inductions, etc. The motor 140 may be fabricated using corrosion resistant materials such as stainless steel.

The monitoring device 150 may include software and/or firmware and other hardware that enables monitoring of the downhole centrifugal pump system 100. In some embodiments, the monitoring device 150 may include one or more sensors (e.g., temperature sensors, pressure sensors, etc.) that may capture information during the operation of the downhole centrifugal pump system 100. This information may be transmitted via a wired and/or wireless channel to user interfaces that facilitate viewing of monitoring data associated with various operations of the downhole centrifugal pump system 100 and/or conditions in which the downhole centrifugal pump system 100 operates.

Figure 2:
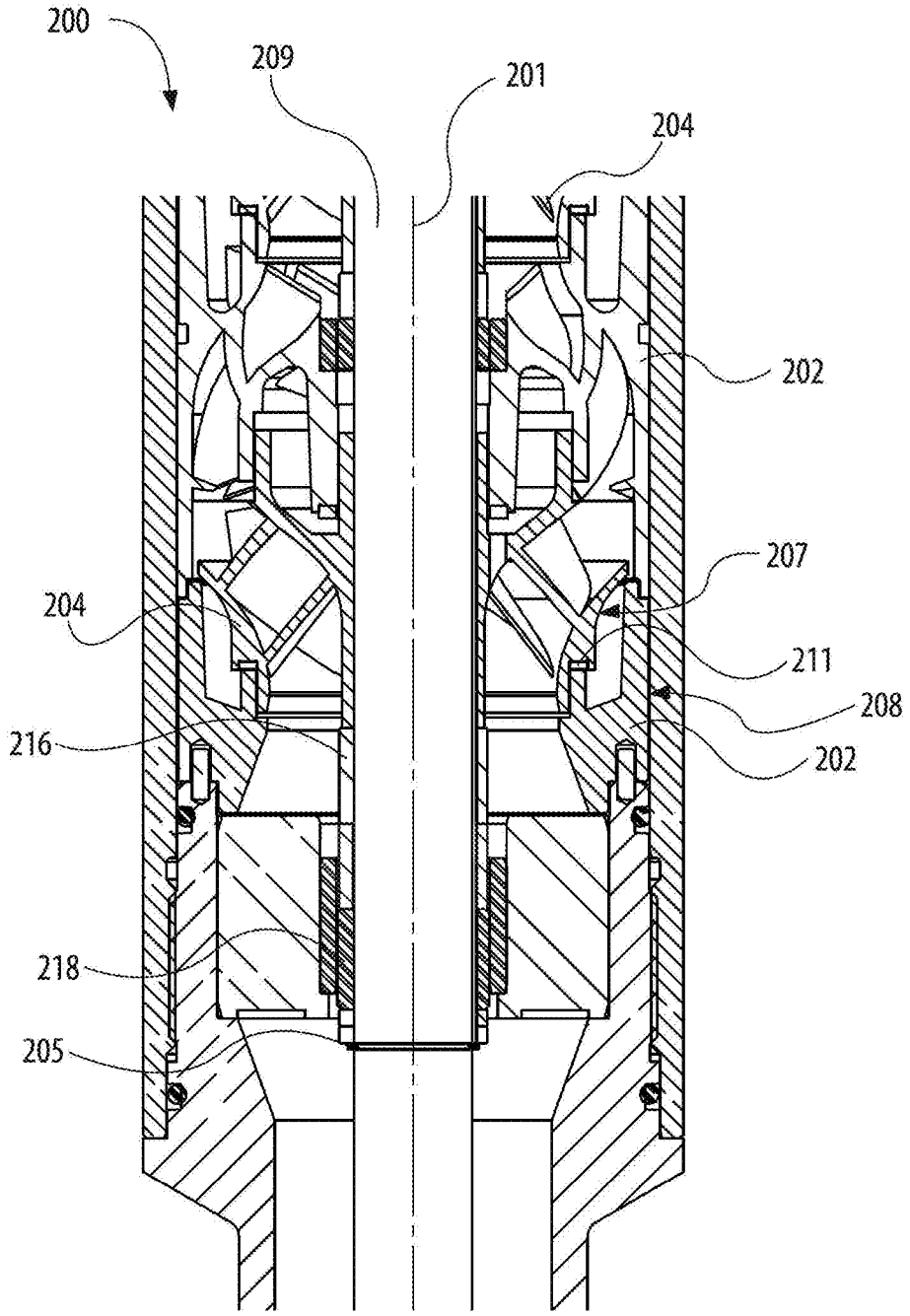
FIG. 2 is a cross-sectional view of a portion of a centrifugal pump having a retaining ring supporting an axial load of an impeller.

FIG. 2 is a cross-sectional view of a portion of a centrifugal pump 200 having a retaining ring 205 supporting an axial load of at least one impeller 204.

As shown in FIG. 2, the centrifugal pump 200 may include a stack of diffusers 202 with impellers 204 positioned in the stack of diffusers 202, the impellers 204 coupled to a shaft 209 to be rotated by the shaft 209. The shaft 209 is coupled to the impellers 204 in order to rotate the impellers 204 about a longitudinal axis 201 of the shaft 209 within the diffusers 202. Rotation of the impellers 204 within the diffusers 202 acts to drive fluid through the centrifugal pump 200. For example, in a downhole application, the impellers 204 drive the fluid from a lowermost or downhole portion of the centrifugal pump 200 where the fluid is supplied through an inlet to a fluid outlet at an uppermost or uphole portion of the centrifugal pump 200.

During rotation of the impellers 204, each of the impellers 204 may generate a downward axial thrust as fluid is directed uphole by the impellers 204. Accordingly, the retaining ring 205 is relied upon to resist the axial forces of at least a bottom impeller 207 that may be transferred through bearings and/or spacers, such as spacers 216 and bearing 218, located on the shaft 209 below the bottom impeller 207, in addition to resisting axially downward gravitational forces that may act on the bottom impeller 207.

The bottom impeller 207 can become axially unsupported if the retaining ring 205, which is located below the bottom impeller 207, becomes unseated from the shaft 209. The amount of force that can be supported by the retaining ring 205 may be heavily dependent on a retaining ring groove of the shaft 209 meeting drawing tolerances. Very small inconsistencies may greatly impact the load the retaining ring 205 can withstand, and such inconsistencies in the retaining ring groove may be difficult to locate during inspection.

Accordingly, during operation, the retaining ring 205 may become unseated from its groove, and the bottom impeller 207 may lose its axial support that transfers the impeller thrust to the shaft 209. Without the retaining ring 205 retaining the axial position of the bottom impeller 207 on the shaft 209, the axial forces acting on the bottom impeller 207 may cause the bottom impeller 207 to contact and rub against a lower thrust washer 211. This force may then wear the lower thrust washer 211 until the lower thrust washer 211 has been worn through. After the lower thrust washer 211 wears through, the bottom impeller 207 will rub directly on an underlying bottom diffuser 208. This causes increased friction and eventually destroys both the bottom impeller 207 and the bottom diffuser 208. Debris from this contact and wearing of the bottom impeller 207 and the bottom diffuser 208 may then travel through the rest of the centrifugal pump 200 and cause damage to other components. Pump performance may be impacted as this damages the ability of the impellers 204 to increase pressure and the increased friction between components increases the load on the motor.

The shaft 209 may also be dependent on the retaining ring 205 for maintaining the running position of the shaft 209. The unseating of the retaining ring 205 may allow the shaft 209 to move axially upward without this constraint. This additional axially upward movement of the shaft 209 can unseat a bottom retaining ring of other pumps located uphole and cause a chain reaction of the other bottom impellers wearing on their bottom diffuser.

Embodiments of the present disclosure discussed herein may inhibit and/or prevent a retaining ring from becoming unseated and/or mitigate the risks of a retaining ring that becomes unseated.

Figure 3:
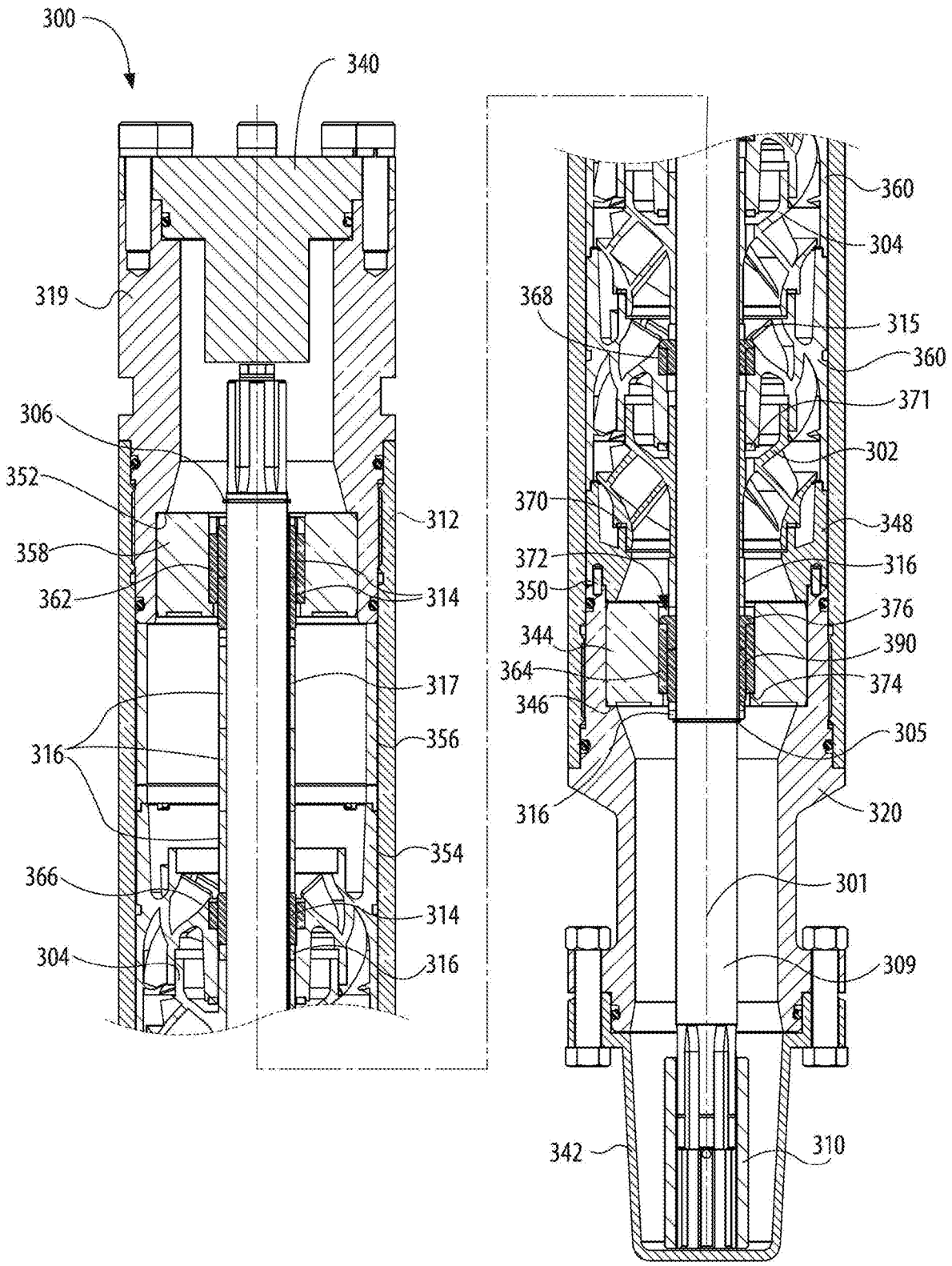
FIG. 3 is a cross-sectional view of a downhole centrifugal pump that includes at least one axial support feature, according to an embodiment of the present disclosure.

FIG. 3 is a cross-sectional view of a downhole centrifugal pump 300 that includes at least one axial support feature, according to an embodiment of the present disclosure, and which may be utilized as the pump 110 in the downhole centrifugal pump system 100 of FIG. 1.

As shown in FIG. 3, the downhole centrifugal pump 300 may include a stack of diffusers 348, 354, 360 with impellers 302, 304 positioned in the stack of diffusers 348, 354, 360, the impellers 302, 304 coupled to a shaft 309 to be rotated by the shaft 309. The shaft 309 is coupled to the impellers 302, 304 in order to rotate the impellers 302, 304 about a longitudinal axis 301 (e.g., an axis of rotation) of the shaft 309 within the diffusers 348, 354, 360. Rotation of the impellers 302, 304 within the diffusers 348, 354, 360 acts to drive fluid through the downhole centrifugal pump 300. For example, in a downhole application, the impellers 302, 304 drive the fluid from a lowermost or downhole portion of the downhole centrifugal pump 300 where the fluid is supplied through an inlet to a fluid outlet at an uppermost or uphole portion of the downhole centrifugal pump 300.

In some embodiments, each of the impellers 302, 304 may be substantially identical to each of the other impellers 302, 304, including a bottom impeller 302 and upper impellers 304. Additionally, the diffusers 348, 354, 360 may comprise a top diffuser 354, a bottom diffuser 348, and a one or more middle diffusers 360, and each middle diffuser 360 may be substantially identical to each other middle diffuser 360. In view of this, greater or fewer numbers of upper impellers 304 and middle diffusers 360 may be included in the downhole centrifugal pump 300 according to the desired pumping specifications.

Various components in addition to the impellers 302, 304 may also be coupled to, and rotate with, the shaft 309. Annular bearings 314, 390, flanged bearings 315, 376, spacers 316, retaining rings 305, 306, may be coupled to the shaft 309, and may rotate with the shaft 309. The impellers 304, the annular bearings 314, the flanged bearings 315, and the spacers 316 may each include a keyway that corresponds to a keyway in the shaft 309 and a key 317 may be inserted into the keyways to prevent the rotation of the impellers 304, the annular bearings 314, the flanged bearings 315, and the spacers 316 relative to the shaft 309 and facilitate their rotation by the shaft 309. For example, each of the keyways of the impellers 304, the annular bearings 314, the flanged bearings 315, the spacers 316, and the shaft 309 may be a groove generally shaped as half of a cylinder such that when the keyways are rotationally aligned a cylindrical passageway is formed, and the key 317 may be a cylinder that substantially fills the cylindrical passageway. It will be understood that other keyway and key shapes may be utilized in additional to cylindrical shapes, such as rectangular prism or cuboid shapes. Each of the retaining rings 305, 306 may be located within a respective groove in the shaft 309 and may be coupled to the shaft 309. For example, the retaining rings 305, 306 may be expanded with a tool to be inserted into the grooves and may be coupled to the shaft 309 via a biasing force of the retaining rings 305, 306 when the tool is removed.

As discussed above, the downhole centrifugal pump 300 may include or be coupled to a motor that drives (e.g., rotates) a shaft 309 and the components coupled to the shaft, such as the impellers 302, 304, the annular bearings 314, the flanged bearings 315, and the spacers 316. Accordingly, a coupler 310 may be located at one or both ends of the shaft 309 to couple that shaft 309 to a shaft of another component, such as a motor, of a system in which the downhole centrifugal pump 300 is installed.

The downhole centrifugal pump 300 may include an outer housing 312 that may have a generally tubular shape. A top end of the outer housing 312 may be coupled to a pump head 319 and a bottom end of the outer housing 312 may be coupled to a pump base 320. For shipping and handling of the downhole centrifugal pump 300 prior to use, a head cap 340 may be coupled to the pump head 319 and a base cap 342 may be coupled to the pump base 320. The head cap 340 and the base cap 342 may be removed prior to installation and use in a downhole centrifugal pump system, such as the downhole centrifugal pump system 100.

A lower bearing support 344 may be located within an opening in the pump base 320 and positioned against a shoulder 346 of the pump base 320, and may be coupled to the pump base 320. A bottom diffuser 348 may coupled to a top end of the pump base 320 and may be located above the lower bearing support 344. Dowel pins 350 may be inserted into openings within the bottom diffuser 348 and the pump base 320 and utilized to rotationally align and inhibit the relative rotation of the bottom diffuser 348 and the pump base 320.

Similarly, an upper bearing support 358 may be located within an opening in the pump head 319 and may be positioned against a shoulder 352 of the pump head 319 and may be coupled to the pump head 319. A top diffuser 354 may be positioned below a bottom end of the pump head 319 and a connecting tube 356 may be sized to fit within a space between the pump head 319 and the top diffuser 354.

Each of the middle diffusers 360, the top diffuser 354, the upper bearing support 358, and the lower bearing support 344 may each include one or more bushings coupled thereto. Bushing 362 may be coupled to the upper bearing support 358 and a bushing 364 may be coupled to the lower bearing support 344. Similarly, bushing 366 may be coupled to the top diffuser 354 and a bushing 368 may be coupled to each of the middle diffusers 360. Accordingly, each of the annular bearings 314 and each of the flanged bearings 315 may be located at least partially within one or more of the bushings 362, 364, 366, 368. Additionally, thrust washers 370, 371 may be positioned at locations between the impellers 302, 304 and the diffusers 348, 354, 360.

The annular bearings 314, the flanged bearings 315, and the bushings 362, 364, 366, 368, may provide an interface between the stationary components (e.g., the middle diffusers 360, the top diffuser 354, the upper bearing support 358, and the lower bearing support 344) and the rotating components (e.g., the shaft 309 and components coupled to the shaft 309). Accordingly, the annular bearings 314, the flanged bearings 315, and/or the bushings 362, 364, 366, 368, may be comprised of a wear-resistant material. For example, the annular bearings 314, the flanged bearings 315, and/or the bushings 362, 364, 366, 368, or wear surfaces of the annular bearings 314, the flanged bearings 315, and/or the bushings 362, 364, 366, 368, may comprise a metallic material (e.g., carbon steel, titanium or titanium alloys, tungsten or tungsten alloys, aluminum or aluminum alloys, or stainless steel, etc.), a carbide material (e.g., tungsten carbide, silicon carbide, etc.), a polycrystalline diamond (PCD) material, or any other suitable material. In some embodiments the annular bearings 314, the flanged bearings 315, and/or the bushings 362, 364, 366, 368 may be comprised of a superhard material that may exhibit a hardness that is equal to or greater than a hardness of tungsten carbide. In some embodiments, the annular bearings 314, the flanged bearings 315, and/or the bushings 362, 364, 366, 368 may be tungsten carbide with a cobalt binder (e.g., about 6% cobalt binder by weight).

The spacers 316 coupled to the shaft 309 may be configured as annular tubes of various lengths, sized and located to substantially fill the space between other components coupled to the shaft 309. Spacers 316 may be located between the annular bearing 390 and the bottom retaining ring 306, the spacers 316 sized to substantially fill the space between the annular bearing 390 and the bottom retaining ring 306. Similarly, spacers 316 may be located between each impeller 302, 304 and adjacent flanged bearings 315 and the respective spacers 316 may be sized to substantially fill the spaces between the impellers 302, 304 and the adjacent flanged bearings 315. For example, the spacers 316 may extend between and contact the bottom impeller 302 and the bottom flanged bearing 315. Accordingly, axial forces (e.g., forces acting in the upward and/or downward direction, parallel to the axis of rotation) acting on the impellers 302, 304 may be transferred to adjacent flanged bearings 315 via the spacers 316.

Figure 4A:
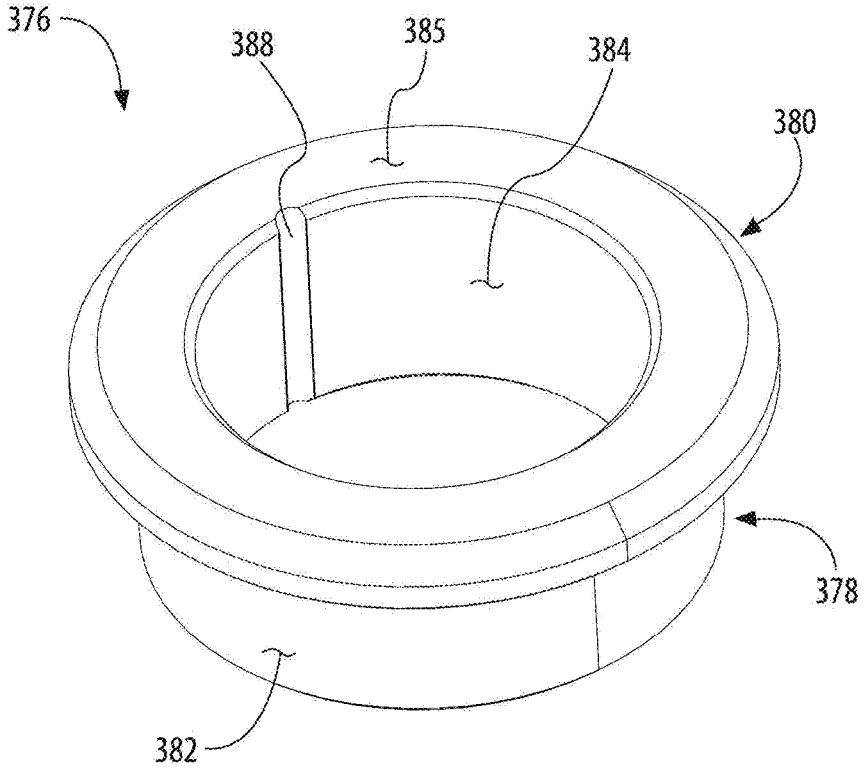
FIG. 4A is an isometric top view of a flanged bearing of the downhole centrifugal pump of FIG. 3, according to an embodiment of the present disclosure.
Figure 4B:
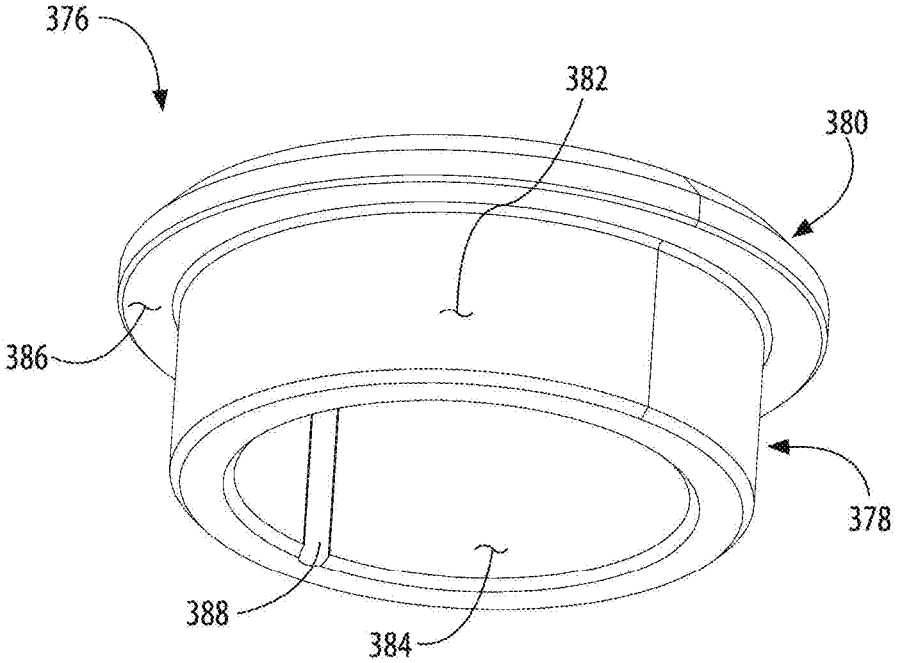
FIG. 4B is an isometric bottom view of the flanged bearing of FIG. 4A.

FIG. 4A is an isometric top view, and FIG. 4B is an isometric bottom view, of the bottom flanged bearing 376 of the downhole centrifugal pump 300 of FIG. 3, according to an embodiment of the present disclosure. In some embodiments, the flanged bearings 315 (see FIG. 3) and the bottom flanged bearing 376 may be substantially identical and interchangeable.

As shown, the flanged bearing 376 may include an annular portion 378 and a flange portion 380, and edges of the flanged bearing 376 may be chamfered. The annular portion 378 may be shaped as an annular tube having a cylindrical outer surface 382 and a cylindrical inner surface 384. The cylindrical inner surface 384 may be sized and shaped to correspond to an outer surface of the shaft 309 and the cylindrical outer surface 382 may be sized and shaped to correspond to an inner surface of a bushing, such as the bushing 364. Accordingly, the cylindrical outer surface 382 may provide a bearing surface that contacts the inner surface of a bushing and maintains the radial position of the flanged bearing 376 relative to the bushing 364 and thus may maintain the radial position of the shaft 309 and components, such as the impellers 302, 304, that are coupled to the shaft 309. A keyway 388 may extend along the cylindrical inner surface 384 and may be sized and configured to receive a portion of the key 317 to couple the flanged bearing 376 to the shaft 309.

The flange portion 380 of the flanged bearing 376 may extend radially outward beyond the cylindrical outer surface 382 of the annular portion 378. The flange portion 380 may include an upper surface 385 and a lower surface 386. The lower surface 386 of the flange portion 380 may have a shape that corresponds to an upper surface of an underlying bushing, such as the bushing 364. For example, the upper surface of the bushing 364 may be substantially planar and the lower surface 386 of the flange portion 380 may be substantially planar, as shown. For another example, the upper surface of the bushing 364 may have a generally frustoconical shape and the lower surface 386 of the flange portion 380 may have a generally frustoconical shape configured to mate with the upper surface of the bushing 364 (not shown). Accordingly, the lower surface 386 of the flange portion 380 may be sized to extend radially over the upper surface of the bushing 364 and provide a bearing surface that contacts the upper surface of the bushing and inhibits the downward axial movement of the flanged bearing 376 and thus inhibits the downward axial movement of overlying components such as an impeller 204.

In view of the foregoing, referring again to FIG. 3, the downhole centrifugal pump 300 may include the diffusers 348, 354, 360 fixedly coupled to the outer housing 312, and the impellers 302, 304 alternatingly interspersed between the diffusers 348, 354, 360. The lower bearing support 344 may be located below the bottom impeller 302 and fixedly coupled to the outer housing 312.

The lower bearing support 344 may include a central opening 372 having a shoulder 374 in a lower portion of the central opening 372, and the bushing 364 may be positioned within and fixedly coupled to the central opening 372 of the lower bearing support 344. A bottom surface of the bushing 364 may be positioned adjacent to the shoulder 374 of the lower bearing support 344, and the shoulder 374 may be sized relative to the bushing 364 to prevent downward axial movement of the bushing 364 beyond the shoulder 374. An annular portion 378 of a lower flanged bearing 376 may be positioned at least partially within the bushing 364 and at least a portion of a flange portion 380 of the lower flanged bearing 376 may extend radially over an upper surface of the bushing 364. The upper surface of the bushing 364 may be sized relative to the flange portion 380 of the lower flanged bearing 376 to prevent downward axial movement of the flange portion 380 beyond the upper surface of the bushing 364. The shaft 309 may pass through the diffusers 348, 354, 360, the impellers 302, 304, the lower bearing support 344, the bushing 364, and the flanged bearing 376, the shaft rotationally coupled to the impellers 302, 304 and the flanged bearing 376 and configured to impart rotation to the impellers 302, 304 and the flanged bearing 376 relative to the bushing 364, the lower bearing support 344, the diffusers 348, 354, 360, and the outer housing 312. An annular bearing 390 may be coupled to the shaft 309 below and adjacent to the lower flanged bearing 376 and may be located at least partially within the bushing 364.

Accordingly, the downhole centrifugal pump 300 may utilize the lower flanged bearing 376 to radially support the shaft 309 and axially support the bottom impeller 302. The shaft 309 may be radially supported by the annular portion 378 of the lower flanged bearing 376 and the annular bearing 390 located at least partially within the bushing 364. Additionally, the shaft 309 and impeller 302 may be axially supported by the flange portion 380 of the lower flanged bearing 376 having the lower surface 386 in contact with the upper surface of the bushing 364. This may restrain the shaft 309 in two perpendicular directions (e.g., in an axial direction and in a radial direction relative to the axis of rotation (longitudinal axis 301) of the shaft 309). The thrust acting on the bottom impeller 302 during operation may be axially supported by transferring the force through the spacers 316, to the lower flanged bearing 376, from the flange portion 380 of the lower flanged bearing 376 to the bushing 364, to the lower bearing support 344 and into the pump base 320. This may remove the thrust force of the bottom impeller 302 from the bottom retaining ring 306 and ensure the bottom impeller 302 maintains the correct position via the pump base 320, rather than the bottom retaining ring 306.

In addition to the lower flanged bearing 376 located below the bottom impeller 302, the downhole centrifugal pump 300 may include upper flanged bearings 315 mounted to the shaft 309 at locations below each of the upper impellers 304, which may each be at least partially located within a respective bushing 368 of the middle diffusers 360. An annular portion 378 of each of the upper flanged bearings 315 may be positioned at least partially within a respective bushing 368. A flange portion 380 of each of the upper flanged bearings 315 may radially extend at least partially over an upper surface of a respective bushing 368.

Accordingly, the upper flanged bearings 315 may restrain the shaft 309 in two perpendicular directions (e.g., in an axial direction and in a radial direction relative to the axis of rotation of the shaft 309), thus providing both radial support and axial support of the shaft 309 and each of the overlying upper impellers 304. The thrust acting on the upper impellers 304 during operation may be axially supported by transferring the force through the spacers 316, to the upper flanged bearings 315 from the flange portion 380 of the upper flanged bearings 315 to the bushings 368, to the diffusers 360, and into the pump base 320.

The flanged bearings 315, 376 may transfer forces from the shaft 309 and the impellers 302, 304 while spinning at approximately 3500 rpm relative to the stationary bushings 364, 368. The pump base 320, the lower bearing support 344, the diffusers 348, 354, 360, and bushing 362, 364, 366, 368 are all stationary relative to the shaft 309, and the impellers 302, 304, the flanged bearings 315, 376, and the spacers 316 that are all keyed to the shaft 309. The flanged bearings 315, 376 may have a Pressure-Velocity (PV) value (e.g., a load carrying capacity) high enough to transfer the thrust from the impellers 304 at a rotational velocity of about 3500 rotations-per-minute (rpm). In some embodiments, the PV of the flanged bearings 376 may be at least about 3 times the normal operating thrust load applied to the respective flanged bearing 315.

The position of the shaft 309 may be axially limited by the impellers 302, 304 being trapped within the diffusers 348, 354, 360, and the spacers 316 may be utilized to take up additional space (e.g., the remaining space) to limit axial movement of the shaft 309. The flanged bearings 315, 376 may also act as a spacer to aid in limiting axial movement of the shaft 309.

The position of the impellers 302, 304 may be similarly axially limited by the spacers 316 taking up space between the impellers 302, 304 and flanged bearings 315, 376. It may be beneficial for the impellers 302, 304 to be permitted a relatively small amount of axial movement, but not so much axial movement that the impellers 302, 304 can wear through a lower thrust washer 370 and contact an underlying diffuser 348, 360.

Figure 5:
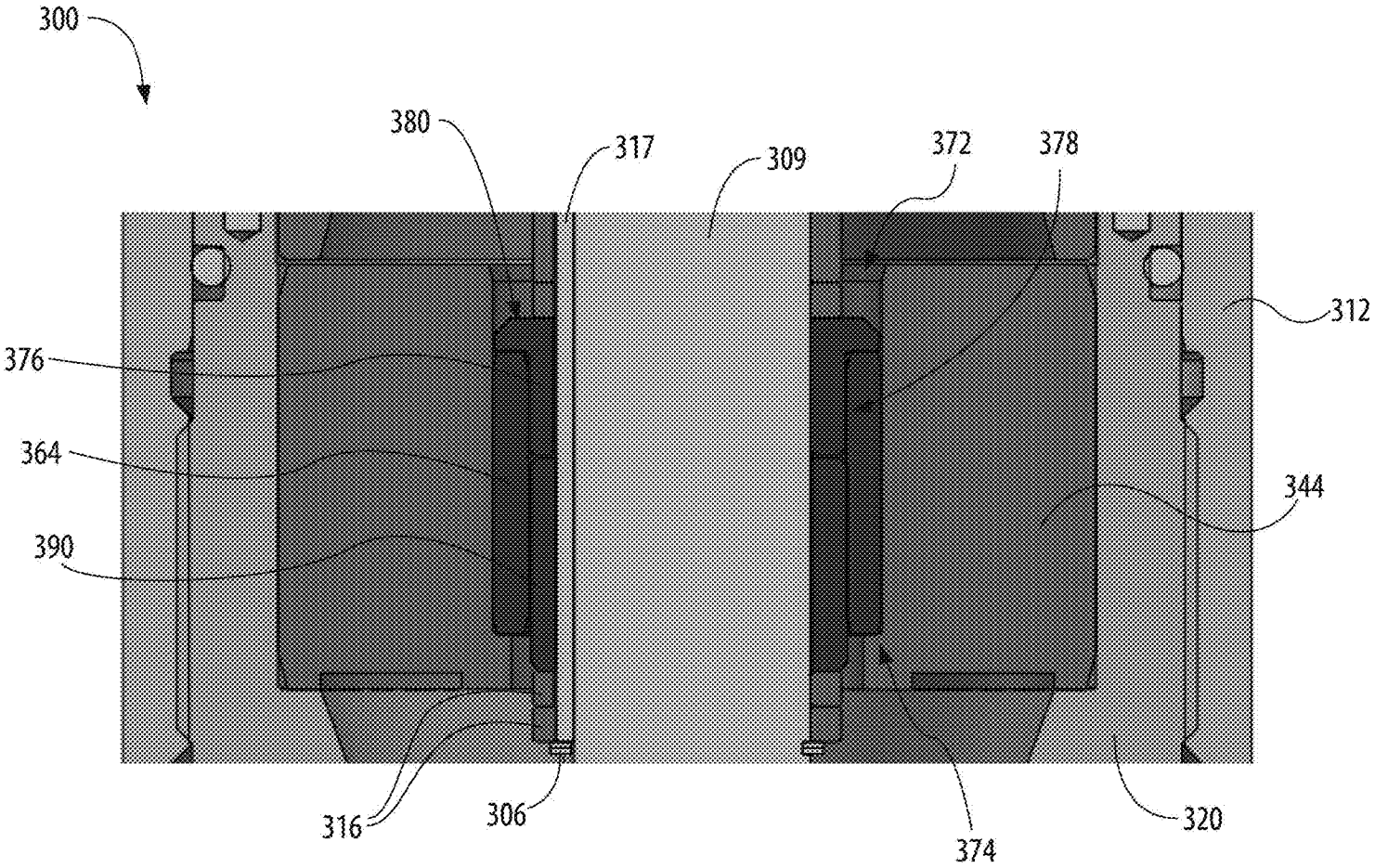
FIG. 5 is a cross-sectional detail view of the lower bearing support of the downhole centrifugal pump of FIG. 3.

FIG. 5 is a cross-sectional detail view of the lower bearing support 344 of the downhole centrifugal pump 300 of FIG. 3.

As shown, the central opening 372 of the lower bearing support 344 may include the shoulder 374 in a lower portion of the central opening 372. The bore of the central opening 372 above the shoulder 374 may be cylindrical and have a consistent diameter from the shoulder to the opening. The central opening 372 may be sized to accommodate the outer diameter of the bushing 364. The bushing 364 may be positioned within and press-fit to the central opening 372 of the lower bearing support 344 with the bottom surface of the bushing 364 positioned adjacent to the shoulder 374.

The flange portion 380 of the lower flanged bearing 376 may have an outer diameter that is smaller than the outer diameter of the bushing 364. Accordingly, the lower flanged bearing 376 may be inserted into the same diameter opening as the bushing 364.

Figure 6:
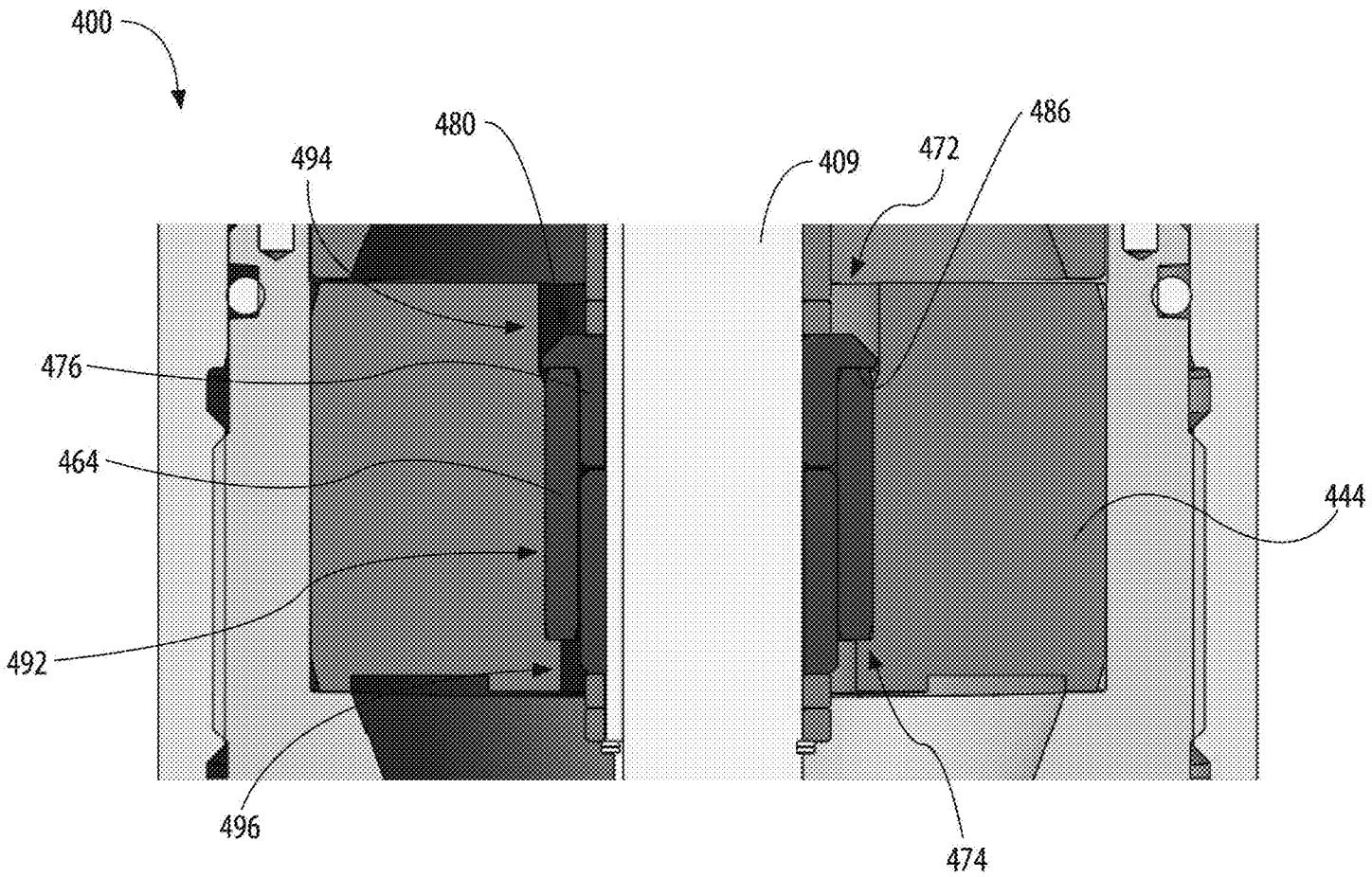
FIG. 6 is a cross-sectional detail view of a lower bearing support of a downhole centrifugal pump, according to an additional embodiment of the present disclosure.

FIG. 6 is a cross-sectional detail view of a lower bearing support 444 of a downhole centrifugal pump 400, according to an additional embodiment of the present disclosure. The downhole centrifugal pump 400 may be substantially identical to the downhole centrifugal pump 300, except that the downhole centrifugal pump 400 may have a shaft 409 that has a different size diameter than the shaft 309 of the downhole centrifugal pump 300 (e.g., an about 11/16 inch (17.5 mm) diameter shaft rather than an about 7/8 inch (22.2 mm) diameter shaft) and may include additional features as described below.

As shown, a central opening 472 of a lower bearing support 444 of the downhole centrifugal pump 400 may include a shoulder 474 in a lower portion of the central opening 472. The bore of the central opening 472 above the shoulder 474 may have two cylindrical regions having differing diameters. A middle portion 492 of the central opening 472 may be sized to accommodate the outer diameter of a bushing 464 and the bushing 464 may be positioned within and fixedly coupled to the middle portion 492 of the central opening 472 of the lower bearing support 444 with the bottom surface of the bushing 464 positioned adjacent to the shoulder 474. An upper portion 494 of the central opening 472, overlying the middle portion 492, may have a diameter that is greater than a diameter of the middle portion 492 and greater than a diameter of the bushing 464. The middle portion 492 may have a length that is less than a length of the bushing 464, such that when the bushing 464 is installed in the middle portion 492 and seated against the shoulder 474 an upper surface of the bushing 464 may extend above the middle portion 492 and extend into the upper portion 494 of the central opening 472 of the lower bearing support 444.

In view of the foregoing, a lower flanged bearing 476 may have a flange portion 480 that is smaller than the diameter of the upper portion 494 of the central opening 472 to fit within the upper portion 494, but larger than the outer diameter of the bushing 464 and larger than the diameter of the middle portion 492. Additionally, a lower surface 486 of the flange portion 480 of the lower flanged bearing 476 may be larger than the upper surface of the bushing 464.

Accordingly, the lower bearing support 444 may have a central opening 472 that includes a lower portion 496, located below the shoulder 474, with a diameter that is smaller than the outer diameter of the bushing 464 to prevent the bushing 464 from entering the lower portion 496, the middle portion 492 with a diameter sized to provide a press fit between the bushing 464 and the middle portion 492, and an upper portion 494 with a diameter larger than the outer diameter of the bushing 464.

Referring again to FIG. 3, the downhole centrifugal pump 300 may be assembled by stacking various components on and about the shaft 309. For example, the components may be stacked starting from the bottom and stacked toward the top, stacked starting from the top and stacked toward the bottom, and/or stacked started at an intermediate location and stacked outward toward the top and bottom.

In some embodiments, the downhole centrifugal pump 300 may be assembled starting from the bottom. Accordingly, the bushing 364 may be press fit into the central opening 372 of the lower bearing support 344 and the lower bearing support 344 may be coupled to the pump base 320. The key 317 may be inserted into the keyway on the shaft 309 and spacers 316, the annular bearing 390, and the lower flanged bearing 376 may be positioned on the shaft with the key 317 extending through keyways in the spacers 316, the annular bearing 390, and the lower flanged bearing 376. Additionally, the bottom retaining ring 305 may be coupled to the shaft. The annular bearing 390 and the annular portion 378 of the lower flanged bearing 376 may then be inserted into the bushing 364 and the lower surface 386 of the flange portion 380 of the lower flanged bearing 376 may be positioned on the upper surface of the lower flanged bearing 376.

Next, the bottom diffuser 348 may be positioned over the shaft 309 and coupled to the pump base 320 with the dowel pins 350. A keyway of the bottom impeller 302 may be aligned with the key 317 and slid onto the key 317 and shaft 309 and positioned into contact with the spacers 316 over the lower flanged bearing 376.

A bushing 368 may be coupled to the middle diffuser 360 via a press-fit and the middle diffuser 360 may then be positioned over the shaft 309 and coupled to the bottom diffuser 348. One or more spacers 316 may be coupled to the shaft 309 above the bottom impeller 302 and a flanged bearing 315 may be coupled to the shaft 309 and key 317 and the annular portion 378 of the flanged bearing 315 may be inserted into the bushing 368 of the middle diffuser 360 and a bottom surface 386 of the flange portion 380 may be positioned into contact with an upper surface of the bushing 368.

One or more spacers 316 may be coupled to the shaft 309 above the flange portion 380 of the upper flanged bearing 315 and may be positioned into contact with the upper flanged bearing 315. A keyway of an upper impeller 304 may be aligned with the key 317 and slid onto the key 317 and shaft 309 and positioned into contact with the spacers 316 over the upper flanged bearing 315. A desired number of middle diffusers 360 and upper impellers 304 may be stacked similarly.

After a desired number of middle diffusers 360 and upper impellers 304 are stacked on the shaft 309, one or more spacers 316 and annular bearings 314 may be coupled to the shaft above the uppermost middle diffusers 360. Additionally, the upper retaining ring 306 may be coupled to the shaft 309 above the annular bearings 314 and spacers 316.

In additional embodiments, a greater number of spacers 316, a fewer number of spacers 316, different sized spacers 316, and/or no spacers 316 may be utilized. For example, in some embodiments, the bottom impeller 302 may be positioned adjacent to the flanged bearing 315 and no spacers 316 may be included between the bottom impeller 302 and the flanged bearing 315. Accordingly, spacers 316 may be utilized to fill space between components where a gap would otherwise be present, or spacers 316 may not be utilized were components are located adjacent to each other with little or no gap therebetween.

The bushing 366 may be coupled to the top diffuser 354 via a press-fit and the top diffuser 354 may be positioned about the shaft 309 over the uppermost middle diffusers 360 and the bushing 366 may be positioned over one or more of the annular bearings 314. The connecting tube 356 may be positioned about the shaft 309 above the top diffuser 354 and coupled to the top diffuser 354. The outer housing 312 may then be positioned over the stack and coupled to the pump base 320.

The bushing 362 may be coupled to the upper bearing support 358 via a press-fit and the upper bearing support 358 may be coupled to the pump head 319. A portion of the pump head 319 may be inserted into an end of the outer housing 312 and coupled to the outer housing 312. Additionally, the bushing 362 may be positioned over one or more of the annular bearings 314.

Optionally, a coupler 310 may be attached to one or both ends of the shaft 309, the head cap 340 may be attached to the pump head 319, and the base cap 342 may be attached to the pump base 320 to prepare the downhole centrifugal pump 300 for transport to the field.

While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the disclosure as hereinafter claimed, including legal equivalents thereof. Further, the words "including," "having," and variants thereof (e.g., "includes" and "has") as used herein, including the claims, shall be open-ended and have the same meaning as the word "comprising" and variants thereof (e.g., "comprise" and "comprises"). In addition, features from one embodiment may be combined with features of another embodiment while still being encompassed within the scope of the disclosure as contemplated by the inventor.

What is claimed is:

1. A downhole centrifugal pump comprising:

a housing;

a plurality of diffusers fixedly coupled to the housing;

a plurality of impellers alternatingly interspersed between the plurality of diffusers;

a bearing support located below the plurality of impellers and fixedly coupled to the housing, the bearing support comprising a central opening having a shoulder in a lower portion of the central opening;

a bushing positioned within and fixedly coupled to the central opening of the bearing support, with a bottom surface of the bushing positioned adjacent to the shoulder, and the shoulder sized relative to the bushing to prevent downward axial movement of the bushing beyond the shoulder;

a flanged bearing with an annular portion and a flange portion, the annular portion of the flanged bearing positioned at least partially within the bushing and at least a portion of the flange portion extending radially over an upper surface of the bushing, the upper surface of the bushing sized relative to the flange portion to prevent downward axial movement of the flange portion beyond the upper surface of the bushing;

a shaft passing through the plurality of diffusers, the plurality of impellers, the bearing support, the bushing, and the flanged bearing, the shaft rotationally coupled to the impellers and the flanged bearing and configured to impart rotation to the impellers and the flanged bearing relative to the housing; and an annular bearing located below the flanged bearing, the annular bearing rotationally coupled to the shaft and located at least partially within the bushing.

2. The downhole centrifugal pump of claim 1, wherein the flanged bearing is comprised of a material having a hardness equal to or greater than tungsten carbide.

3. The downhole centrifugal pump of claim 1, wherein each of the flanged bearing, the annular bearing, and the bushing has a hardness equal to or greater than tungsten carbide.

4. The downhole centrifugal pump of claim 1, further comprising a retaining ring coupled to the shaft at a location below the flanged bearing.

5. The downhole centrifugal pump of claim 1, further comprising at least one spacer coupled to the shaft at a location between the plurality of impellers and the flanged bearing, the at least one spacer extending axially between and in contact with a bottom impeller of the plurality of impellers and the flanged bearing.

6. The downhole centrifugal pump of claim 5, the at least one spacer extending axially between and in contact with the bottom impeller of the plurality of impellers and the flanged bearing, wherein the at least one spacer is located and configured to transfer axial forces from the bottom impeller to the flanged bearing.

7. The downhole centrifugal pump of claim 1, wherein the flange portion of the flanged bearing extends radially beyond an outer diameter of the bushing.

8. A centrifugal pump comprising:

a bottom impeller;

a bearing support located below the bottom impeller;

a bushing fixedly coupled to the bearing support;

a flanged bearing positioned at least partially within the bushing, the flanged bearing having a flange extending radially over at least a portion of an upper surface of the bushing; and a shaft passing through the bottom impeller, the bearing support, the bushing, and the flanged bearing, the shaft rotationally coupled to the bottom impeller and the flanged bearing and configured to impart rotation to the bottom impeller and the flanged bearing relative to the bearing support and the bushing; and wherein the flange of the flanged bearing extends radially beyond an outer diameter of the bushing.

9. The centrifugal pump of claim 8, further comprising an annular bearing located below the flanged bearing, the annular bearing rotationally coupled to the shaft and located at least partially within the bushing.

10. The centrifugal pump of claim 8, wherein the flange of the flanged bearing comprises a substantially planar lower surface positioned adjacent a substantially planar upper surface of the bushing.

11. The centrifugal pump of claim 8, wherein the bearing support comprises an opening comprising a lower portion with a diameter that is smaller than an outer diameter of the bushing to prevent the bushing from entering the lower portion, and a middle portion with a diameter sized to provide a press fit between the bushing and the middle portion.

12. The centrifugal pump of claim 11, wherein the opening further comprises an upper portion with a diameter larger than the outer diameter of the bushing.

13. The centrifugal pump of claim 12, wherein the flange of the flanged bearing is located in the upper portion.

14. The centrifugal pump of claim 8, wherein the flanged bearing is comprised of tungsten carbide.

15. The centrifugal pump of claim 8, further comprising at least one spacer coupled to the shaft and extending axially between and in contact with the bottom impeller and the flanged bearing.

16. The centrifugal pump of claim 15, wherein the at least one spacer is configured to transfer axial forces from the bottom impeller to the flanged bearing.

17. The centrifugal pump of claim 8, wherein the bushing is comprised of tungsten carbide.

18. The centrifugal pump of claim 8 further comprising:

an upper impeller;

a diffuser located between the bottom impeller and the upper impeller;

an upper bushing fixedly coupled to the diffuser; and an upper flanged bearing positioned at least partially within the upper bushing, the upper flanged bearing having a flange extending radially over at least a portion of an upper surface of the upper bushing.

19. A method of assembling the centrifugal pump of claim 9, the method comprising:

coupling the bushing to the bearing support;

coupling the bottom impeller to the shaft;

coupling the flanged bearing to the shaft, below the bottom impeller;

inserting a lower portion of the flanged bearing into the bushing and positioning the flange of the flanged bearing onto the upper surface of the bushing.

20. The method of claim 19, wherein coupling the bushing to the bearing support comprises press-fitting the bushing into an opening in the bearing support and positioning a lower surface of the bushing against a shoulder in the opening.

21. The method of claim 19, further comprising coupling at least one spacer to the shaft and positioning the at least one spacer to extend from the bottom impeller to the flanged bearing.

22. The method of claim 19, wherein positioning the flange of the flanged bearing onto the upper surface of the bushing further comprises positioning the flange to extend beyond the outer diameter of the bushing.

23. A downhole centrifugal pump comprising:

a housing;

a plurality of diffusers fixedly coupled to the housing;

a plurality of impellers alternatingly interspersed between the plurality of diffusers;

a bearing support located below the plurality of impellers and fixedly coupled to the housing, the bearing support comprising a central opening having a shoulder in a lower portion of the central opening;

a bushing positioned within and fixedly coupled to the central opening of the bearing support, with a bottom surface of the bushing positioned adjacent to the shoulder, and the shoulder sized relative to the bushing to prevent downward axial movement of the bushing beyond the shoulder;

a flanged bearing with an annular portion and a flange portion, the annular portion of the flanged bearing positioned at least partially within the bushing and at least a portion of the flange portion extending radially over an upper surface of the bushing, the upper surface of the bushing sized relative to the flange portion to prevent downward axial movement of the flange portion beyond the upper surface of the bushing; and a shaft passing through the plurality of diffusers, the plurality of impellers, the bearing support, the bushing, and the flanged bearing, the shaft rotationally coupled to the impellers and the flanged bearing and configured to impart rotation to the impellers and the flanged bearing relative to the housing; and wherein the flange portion of the flanged bearing extends radially beyond an outer diameter of the bushing.

* * * * *